US012760919B2

(12) United States Patent
Selvakani

(10) Patent No.: US 12,760,919 B2
(45) Date of Patent: Oct. 13, 2026

(54) SYSTEM FOR PREDICTING FAN MOTOR FAILURE AND A METHOD THEREOF

(71) Applicant: Carrier Corporation, Palm Beach Gardens, FL (US)

(72) Inventor: Kanna Selvakani, Theni (IN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 462 days.

(21) Appl. No.: 18/485,894

(22) Filed: Oct. 12, 2023

(65) Prior Publication Data

US 2024/0125501 A1 Apr. 18, 2024

Related U.S. Application Data

(60) Provisional application No. 63/379,347, filed on Oct. 13, 2022.

(51) Int. Cl.
*F24F 11/38* (2018.01)
*F24F 11/63* (2018.01)
*F24F 110/10* (2018.01)

(52) U.S. Cl.
CPC ..... *F24F 11/38* (2018.01); *F24F 11/63* (2018.01); *F24F 2110/10* (2018.01)

(58) Field of Classification Search
None
See application file for complete search history.

(56) References Cited

U.S. PATENT DOCUMENTS 5,838,124 A 11/1998 Hill
6,992,451 B2 1/2006 Kamio et al.
7,171,946 B1 2/2007 Watanabe
(Continued)

FOREIGN PATENT DOCUMENTS

CN 102684595 B 5/2015
CN 104712214 B 5/2017
(Continued)

OTHER PUBLICATIONS

WO2019119913A1, IDS reference, translation (Year: 2019).*
(Continued)

*Primary Examiner* — Lina Cordero
(74) *Attorney, Agent, or Firm* — Souad Hakim

(57) ABSTRACT

A system for predicting failure of an HVAC fan motor unit includes a fan motor controller for measuring a time duration between reception of the deactivation signal from the control circuitry and speed of a fan reaching zero rotations per minute (RPM). The measured time duration is then transmitted to the control circuitry. The control circuitry stores a set of test time durations characterizing a working fan motor unit. During operation, the control circuitry periodically transmits an activation signal or a deactivation signal to the fan motor controller. The control circuitry receives and compares the measured time duration from the fan motor controller with a test time duration to generate a delta time duration variable. Subsequently, the control circuitry determines if the generated delta time duration variable exceeds a threshold time duration and predicts a failure time duration for the generated delta time duration to reach the threshold time duration.

20 Claims, 4 Drawing Sheets

(56) References Cited

U.S. PATENT DOCUMENTS

| | | | | |
|---|---|---|---|---|
| 7,190,138 | B2 | 3/2007 | Kamio et al. | |
| 7,245,225 | B2 | 7/2007 | Kamio et al. | |
| 7,667,427 | B2 | 2/2010 | Kamio et al. | |
| 2007/0097721 | A1* | 5/2007 | Chou | H05K 7/20209 363/141 |
| 2010/0033119 | A1* | 2/2010 | Becerra | H02P 6/06 236/51 |
| 2015/0241856 | A1 | 8/2015 | Walser et al. | |
| 2015/0373877 | A1* | 12/2015 | Ragupathi | H05K 7/20836 361/679.48 |
| 2017/0293293 | A1 | 10/2017 | Brownie et al. | |
| 2017/0343228 | A1 | 11/2017 | Dyess et al. | |
| 2020/0235680 | A1 | 7/2020 | Kameyama | |

FOREIGN PATENT DOCUMENTS

| | | | | | |
|---|---|---|---|---|---|
| CN | 115111723 | A | * | 9/2022 | F24F 11/64 |
| GB | 630051 | A | | 10/1949 | |
| JP | S5641793 | A | | 4/1981 | |
| JP | 2015092795 | A | | 5/2015 | |
| KR | 19990025251 | A | | 4/1999 | |
| KR | 101543080 | B1 | | 8/2015 | |
| TW | 200800476 | A | | 1/2008 | |
| WO | 2019119913 | A1 | | 6/2019 | |

OTHER PUBLICATIONS

CN115111723A translation (Year: 2022).*
Extended European Search Report received for EP Application No. 23203051.0, mailed on Feb. 22, 2024, 8 Pages.

* cited by examiner

SYSTEM FOR PREDICTING FAN MOTOR FAILURE AND A METHOD THEREOF

CROSS REFERENCE TO RELATED APPLICATIONS

This application claims the benefit of U.S. Provisional Patent Application No. 63/379,347 filed on Oct. 13, 2022, which is incorporated by reference herein in its entirety.

TECHNICAL FIELD OF THE DISCLOSURE

The disclosure relates generally to Heating, Ventilating, or Air Conditioning (HVAC) systems. More particularly, the disclosure relates to predicting fan motor failure in an HVAC system.

BACKGROUND

Heating, Ventilation, and Air Conditioning (HVAC) systems generally refer to the use of several technologies to control multiple ambient parameters of an enclosed space. These parameters include, but are not limited to, temperature, humidity, purity, etc., of the air within the space. As such, HVAC systems work to regulate the air quality and temperature to ensure the air within the enclosed space is comfortable and habitable irrespective of the environmental conditions outside the enclosed space. For instance, during winter, the HVAC system works as a heater to increase the temperature within the enclosed space. On the other hand, during summers, the HVAC system works to lower the temperature within the enclosed space. Consequently, the HVAC system employs several sensors, controllers, actuators, heat exchangers, compressor, condensing systems, throttling devices, fans, and the like to achieve optimum ranges of temperature, humidity, and air quality within the enclosed space.

Typically, in HVAC systems, air flow is supplied into the enclosed space using one or more blower fans. The blower motor is actuated based on a trigger signal from a thermostat, which in turn causes the blower fan to rotate and, thereby causing air to move through the HVAC system. Among other things, this makes ambient air move over the evaporator coils and into the enclosed space or room whose temperature is to be regulated. The refrigerant flowing within the evaporator coils absorb the heat of the ambient air causing its temperature to drop. As a result, the blower fan supplies cold air into the enclosed space or room thereby cooling the room efficiently. Alternatively, for heating during winters, the blower fans blow air over heating coils which heat the incoming cold air to a higher temperature. This heated air is recirculated into the enclosed space or room to be heated thereby heating the room efficiently. The size and power of the blower motor may be selected based on design, for example, distance of the enclosed space or room from the blower fan, the airflow rate, dimensions of the room to be cooled, etc. The air may be supplied through a network of ducts providing plenty of cool air for every room. Therefore, the blower motor is an essential part of any HVAC system. In case the blower motor malfunctions or is subject to damage, that is if the fan stops turning, air will stop moving through the system and the HVAC system does not regulate temperature efficiently and may be repaired.

In smaller applications, such as HVAC applications in vehicles or for residential use, DC motor-driven blower fans are a relatively simple and well-known mechanism used to circulate air. In such applications, the blower fan blows the air through a heat exchanger, such as a radiator, condenser or evaporator, or through an air filter. The air that flows through the heat exchanger may be used as a source of heating or cooling, for example in a car's heating, ventilation and air conditioning (HVAC) system or in regulating the temperature of a car's engine, motor, or battery pack. Generally, blower motors have a prolonged lifespan. However, they can eventually age and malfunction. There may be several reasons or causes for blower motors to malfunction, such as, tripped circuit breakers, a faulty thermostat, etc. However, it is also possible that the blower motor has stopped working entirely. For example, if the bearings or electric components such as windings of the blower motor are constantly exposed to excessive heat, then the blower fan components are highly prone to failure or malfunctioning over time. Another cause includes exposure of the blower motor, its casings, or other components to moisture. Moisture damage arises from exposure to humidity, proximity to leaky ceilings or floors, incorrectly installed pipes, and the like. If the blower motor is exposed to water or moisture, the motor casing and control panels become highly susceptible to corrosion. Any water near wires and electric components of the blower motor may cause short circuit and irreversible damage. The best way to prevent damage to the blower and/or blower motor is by placing a dehumidifier in the utility room housing the air handling unit (AHU). Alternatively, relocating the blower motor unit away from incorrectly installed piping or other sources of moisture is desirable.

Apart from the aforementioned causes of blower fan motor failure, several other causes such as orientation or placement issues, bearing failure, high current draw, electrical failure in the windings, dirt accumulation, aging, etc., ensure blower fan damage over an extensive period or a short period of use. Moreover, blower fan motor failure can be caused by increased frictional wear and/or degradation of linkages over time. Accordingly, a system that allows the fan motor assembly to be periodically monitored to ensure maintenance or repair at the right time instead of waiting until the blower fan motor is irreversibly damaged is therefore desirable. Conventional blower fan motors typically only output a feedback signal indicating the actuator position, but do not output or report any other types of data. Other exemplary solutions employ a plurality of sensors to diagnose the existing state of the fan motor assembly. However, this solution involves increased costs and additional complexity due to susceptibility of the sensors to damage under the same conditions of moisture or overheating through which the fan motor is subjected. Furthermore, incorrect orientation or positioning of the sensors may lead to faulty diagnosis of the condition of the fan motor assembly. Accordingly, failure of the fan motor assembly may occur with no warning, resulting in a period of ineffective equipment operation until the faulty component is repaired or replaced. Although replacement or repair can be completed quickly, sourcing the requisite spare part or replacement may be delayed. A solution that warns maintenance personnel or users or operating personnel of a probable failure well in advance of the event is desirable for improved convenience and quicker turnaround times. It would be highly preferable if the solution has minimal increase of complexity or costs failing which the solution may become prohibitively inefficient and expensive to implement.

Hence, a system capable of monitoring an HVAC fan motor assembly and predicting a failure event without being prohibitively complex or expensive to implement in existing HVAC fan motor assemblies, is desirable. Moreover, a system, capable of notifying maintenance personnel, operating personnel, or building management systems about a tentative time duration within which inspection or maintenance may be carried out for the monitored HVAC fan motor assembly, is desirable.

SUMMARY

This summary is provided to introduce a selection of concepts in a simplified format that are further described in the detailed description of the disclosure. This summary is not intended to identify key or essential inventive concepts of the disclosure, nor is it intended for determining the scope of the disclosure.

The disclosure discloses a system, capable of monitoring an HVAC fan motor assembly and predicting a failure event without being prohibitively complex or expensive to implement in existing HVAC fan motor assemblies. Moreover, the disclosure discloses a system, capable of notifying maintenance personnel, operating personnel, or building management systems about a tentative time duration within which inspection or maintenance may be carried out for the monitored HVAC fan motor assembly.

The system, disclosed herein, for predicting failure of an HVAC fan motor unit comprises at least one HVAC fan motor unit adapted to drive at least one fan and a control circuitry. The HVAC fan motor unit comprises a fan motor controller configured to measure a time duration between reception of the deactivation signal from the control circuitry and speed of the at least one fan reaching zero rotations per minute (RPM) upon receiving a deactivation signal from the control circuitry. Next, the fan motor controller transmits the measured time duration to the control circuitry. The control circuitry is configured to store a set of test time durations characterizing a working fan motor unit. The control circuitry transmits, periodically, an activation signal or a deactivation signal to the fan motor controller of the HVAC fan motor unit. Upon transmitting each deactivation signal, the control circuitry receives the measured time duration from the fan motor controller. The control circuitry then compares the received time duration with a test time duration from the set of stored test time durations to generate a delta time duration variable. The control circuitry determines if the generated delta time duration variable exceeds a threshold time duration and predicts a failure time duration for the generated delta time duration to reach the threshold time duration.

In an exemplary embodiment according to the disclosure, the control circuitry transmits the activation signal during a heating cycle based on a temperature of an enclosed space falling below a predefined temperature.

In an exemplary embodiment according to the disclosure, the control circuitry transmits the deactivation signal during a heating cycle based on a temperature of an enclosed space rising above a predefined temperature.

In an exemplary embodiment according to the disclosure, the control circuitry transmits the activation signal during a cooling cycle based on a temperature of an enclosed space rising above a predefined temperature.

In an exemplary embodiment according to the disclosure, the control circuitry transmits the deactivation signal during a cooling cycle based on a temperature of an enclosed space falling below a predefined temperature.

In an exemplary embodiment according to the disclosure, the control circuitry is configured to receive an input for adjusting the predefined temperature of the enclosed space.

In an exemplary embodiment according to the disclosure, the fan motor controller is configured to measure the time duration between reception of the deactivation signal from the control circuitry and speed of the at least one fan reaching zero rotations per minute (RPM) upon receiving the deactivation signal during the heating cycle or the cooling cycle.

In an exemplary embodiment according to the disclosure, predicting the failure time duration for the generated delta time duration to exceed the threshold time duration comprises performing a simple linear regression to fit a line to the delta time duration variables generated for each deactivation signal during a monitoring period. A slope of the line is identified as a rate-of-change of the delta time duration variables during the monitoring period. Finally, the failure time duration at which the value of the delta time duration variables will reach the threshold time duration is predicted based on extrapolation of the identified slope to meet the threshold time duration.

In an exemplary embodiment according to the disclosure, the control circuitry is configured to generate one of an audio notification, a haptic notification, and a visual notification on a computing device based on the generated delta time duration variable exceeding the threshold time duration.

In an exemplary embodiment according to the disclosure, the control circuitry is configured to indicate the predicted failure time duration on at least one of an interface of a computing device and a service interface of the HVAC fan motor unit.

Also disclosed herein is a method for predicting failure of an HVAC fan motor unit. The method includes measuring, using a fan motor controller, a time duration between reception of a deactivation signal indicative of switching off at least one fan from a control circuitry and speed of the at least one fan reaching zero rotations per minute (RPM). Next, using the fan motor controller, the measured time duration is transmitted to the control circuitry. A set of test time durations characterizing a working fan motor unit is stored in the control circuitry. Next, the control circuitry periodically transmits one of an activation signal and the deactivation signal to the fan motor controller of the HVAC fan motor unit. The control circuitry receives, upon periodically transmitting the deactivation signal by the control circuitry, the measured time duration from the fan motor controller. The control circuitry compares the received time duration with at least one test time duration from the set of stored test time durations to generate a delta time duration variable. The control circuitry determines if the generated delta time duration variable exceeds a threshold time duration. Finally, the control circuitry predicts a failure time duration for the generated delta time duration to reach the threshold time duration.

In an exemplary embodiment according to the disclosure, the step of predicting the failure time duration for the generated delta time duration to exceed the threshold time duration includes performing a linear regression to fit a line to the delta time duration variables generated for the periodically transmitted deactivation signals during a monitoring period. Next, a slope of the line is identified as a rate-of-change of the delta time duration variables during the monitoring period. The control circuitry predicts the failure time duration at which the value of the delta time duration variables will reach the threshold time duration based on extrapolation of the identified slope.

In an exemplary embodiment according to the disclosure, the control circuitry is configured to generate at least one of an audio notification, a haptic notification, and a visual notification on a computing device via a communications network based on the generated delta time duration variable exceeding the threshold time duration.

In an exemplary embodiment according to the disclosure, the control circuitry is configured to indicate the predicted failure time duration on at least one of an interface of a computing device and a service interface of the HVAC fan motor unit.

In an exemplary embodiment according to the disclosure, the control circuitry transmits the activation signal during a heating cycle based on a temperature of an enclosed space falling below a predefined temperature.

In an exemplary embodiment according to the disclosure, the control circuitry transmits the deactivation signal during a heating cycle based on a temperature of an enclosed space rising above a predefined temperature.

In an exemplary embodiment according to the disclosure, the control circuitry transmits the activation signal during a cooling cycle based on a temperature of an enclosed space rising above a predefined temperature.

In an exemplary embodiment according to the disclosure, the control circuitry transmits the deactivation signal during a cooling cycle based on a temperature of an enclosed space falling below a predefined temperature.

In an exemplary embodiment according to the disclosure, the control circuitry is configured to receive an input for adjusting the predefined temperature of the enclosed space.

In an exemplary embodiment according to the disclosure, the fan motor controller is configured to measure the time duration between reception of the deactivation signal from the control circuitry and speed of the at least one fan reaching zero rotations per minute (RPM) upon receiving the periodically transmitted deactivation signal during one of the heating cycle and the cooling cycle.

To further clarify the advantages and features of the method and system, a more particular description of the method and system will be rendered by reference to specific embodiments thereof, which is illustrated in the appended drawing. It is appreciated that these drawings depict only typical embodiments of the disclosure and are therefore not to be considered limiting its scope. The disclosure will be described and explained with additional specificity and detail with the accompanying drawings.

BRIEF DESCRIPTION OF THE DRAWINGS

These and other features, aspects, and advantages will become better understood when the following detailed description is read with reference to the accompanying drawings in which like characters represent like parts throughout the drawings, wherein.

Figure 1:
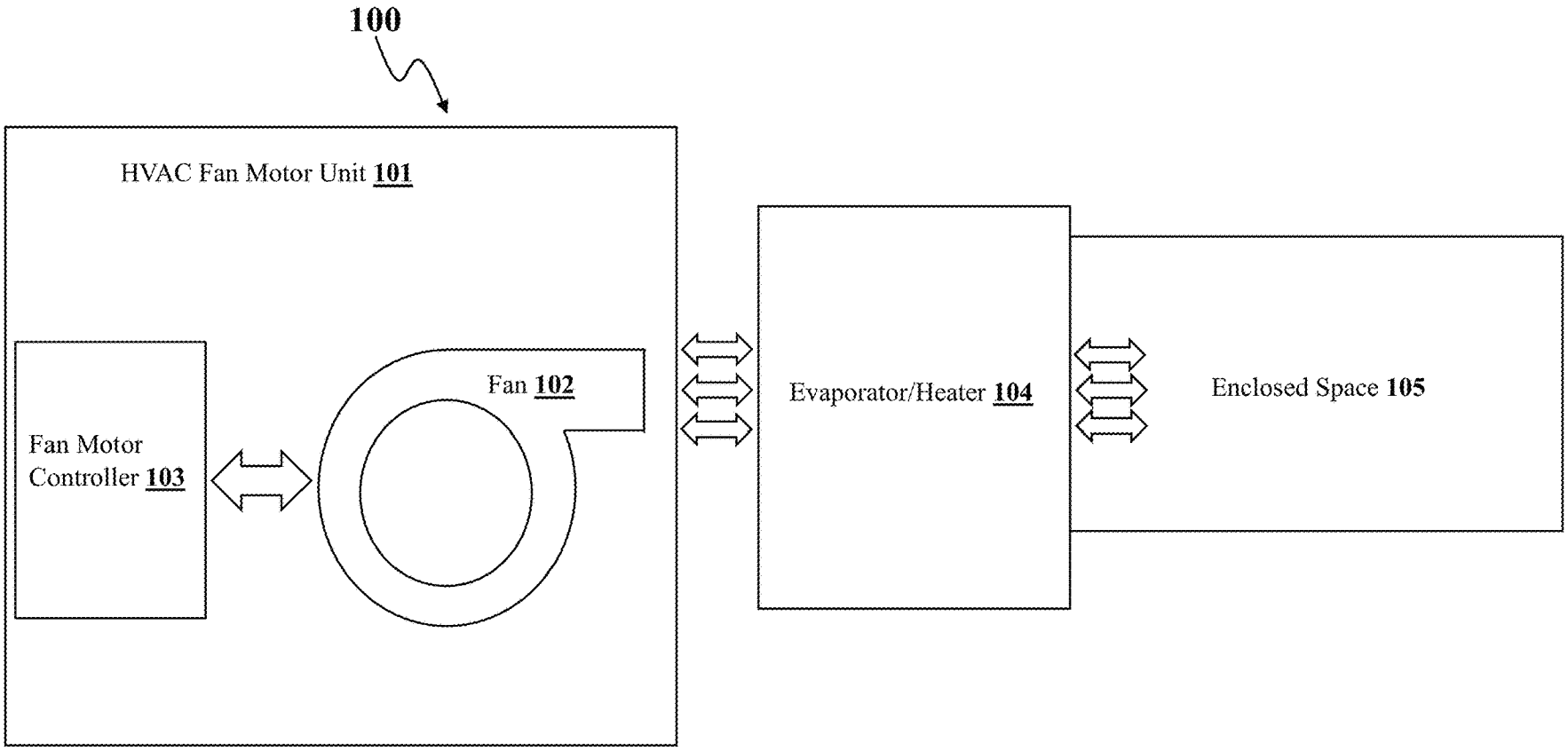
FIG. 1 illustrates a block diagram depicting an HVAC fan motor unit configured to supply air to an enclosed space, according to an embodiment of the disclosure.

Further, skilled artisans will appreciate that elements in the drawings are illustrated for simplicity and may not have necessarily been drawn to scale. For example, the flow charts illustrate the method in terms of the most prominent steps involved to help to improve understanding of aspects of the disclosure. Furthermore, in terms of the construction of the device, one or more components of the device may have been represented in the drawings by conventional symbols, and the drawings may show only those specific details that are pertinent to understanding the embodiments of the disclosure so as not to obscure the drawings with details that will be readily apparent to those of ordinary skill in the art having the benefit of the description herein.

DETAILED DESCRIPTION

It should be understood at the outset that although illustrative implementations of embodiments are illustrated below, system and method may be implemented using any number of techniques. The disclosure should in no way be limited to the illustrative implementations, drawings, and techniques illustrated below, including the exemplary design and implementation illustrated and described herein, but may be modified within the scope of the appended claims along with their full scope of equivalents.

The term "some" as used herein is defined as "one, or more than one, or all." Accordingly, the terms "one," "more than one," but not all" or "all" would all fall under the definition of "some." The term "some embodiments" may refer to no embodiments or one embodiment or several embodiments or all embodiments. Accordingly, the term "some embodiments" is defined as meaning "one embodiment, or more than one embodiment, or all embodiments."

The terminology and structure employed herein are for describing, teaching, and illuminating some embodiments and their specific features and elements and do not limit, restrict, or reduce the spirit and scope of the claims or their equivalents.

More specifically, any terms used herein such as but not limited to "includes," "comprises," "has," "have" and grammatical variants thereof do not specify an exact limitation or restriction and certainly do not exclude the possible addition of one or more features or elements, unless otherwise stated, and must not be taken to exclude the possible removal of one or more of the listed features and elements, unless otherwise stated with the limiting language "must comprise" or "needs to include."

The term "unit" used herein may imply a unit including, for example, one of hardware, software, and firmware or a combination of two or more of them. The "unit" may be interchangeably used with a term such as logic, a logical block, a component, a circuit, and the like. The "unit" may be a minimum system component for performing one or more functions or may be a part thereof.

Unless otherwise defined, all terms, and especially any technical and/or scientific terms, used herein may be taken to have the same meaning as commonly understood by one having ordinary skill in the art.

Embodiments will be described below in detail with reference to the accompanying drawings.

FIG. 1 exemplarily illustrates a block diagram depicting an HVAC fan motor unit 101 configured to supply air to an enclosed space 105, according to an embodiment of the disclosure. An HVAC system functions primarily as a heater during winter when ambient temperatures fall below a predefined temperature. For example, a user or operator of the HVAC system may adjust the thermostat to a temperature of his/her preference, for example 23-28 degrees Celsius. As used herein, the "predefined temperature" refers to an acceptable range of temperatures of the enclosed space 105 that is set by the user or the operator. During a heating cycle, based on a temperature of the enclosed space 105 falling below the predefined temperature, a fan motor controller 103 actuates the HVAC fan motor unit 101 to drive the fan 102 to blow air over heating coils of the heater 104 in contact with the air within the enclosed space 105. The heated air circulates within the enclosed space 105 to raise the temperature to the predefined temperature range. Once the temperature of the enclosed space 105 rises above the predefined temperature, accordingly, the fan motor controller 103 deactivates the fan motor unit 101 to stop rotation of the fan 102 to supply air.

The HVAC system functions primarily as a cooler during summer when ambient temperatures rise above the predefined temperature. In this scenario, during a cooling cycle based on the temperature of the enclosed space 105 rising above the predefined temperature, the fan motor controller 103 actuates the fan motor unit 101 to drive the fan 102 to blow air over evaporator coils (containing refrigerant) of the evaporator 104 in contact with the air within the enclosed space 105. Similarly, a control circuitry 106 (exemplarily illustrated in FIG. 2), transmits the deactivation signal during a cooling cycle based on the temperature of the enclosed space 105 falling below the predefined temperature.

Over time, failure of the fan motor unit 101 may occur due to several reasons. For example, consistent exposure to dirt and dust particles may cause rotary components of the fan motor unit 101 to become stuck (e.g., stuck open, stuck closed, or stuck an intermediate position). The failure of the fan motor unit 101 can also be caused by increased frictional wear and/or degradation of linkages and equipment components over time. Such wear and degradation can be accelerated by corrosive salt air if the equipment is installed in a marine environment or near sources of moisture. Sudden spikes in current drawn, damage to motor winding are other causes due to which the fan motor unit 101 becomes damaged beyond repair.

Figure 2:
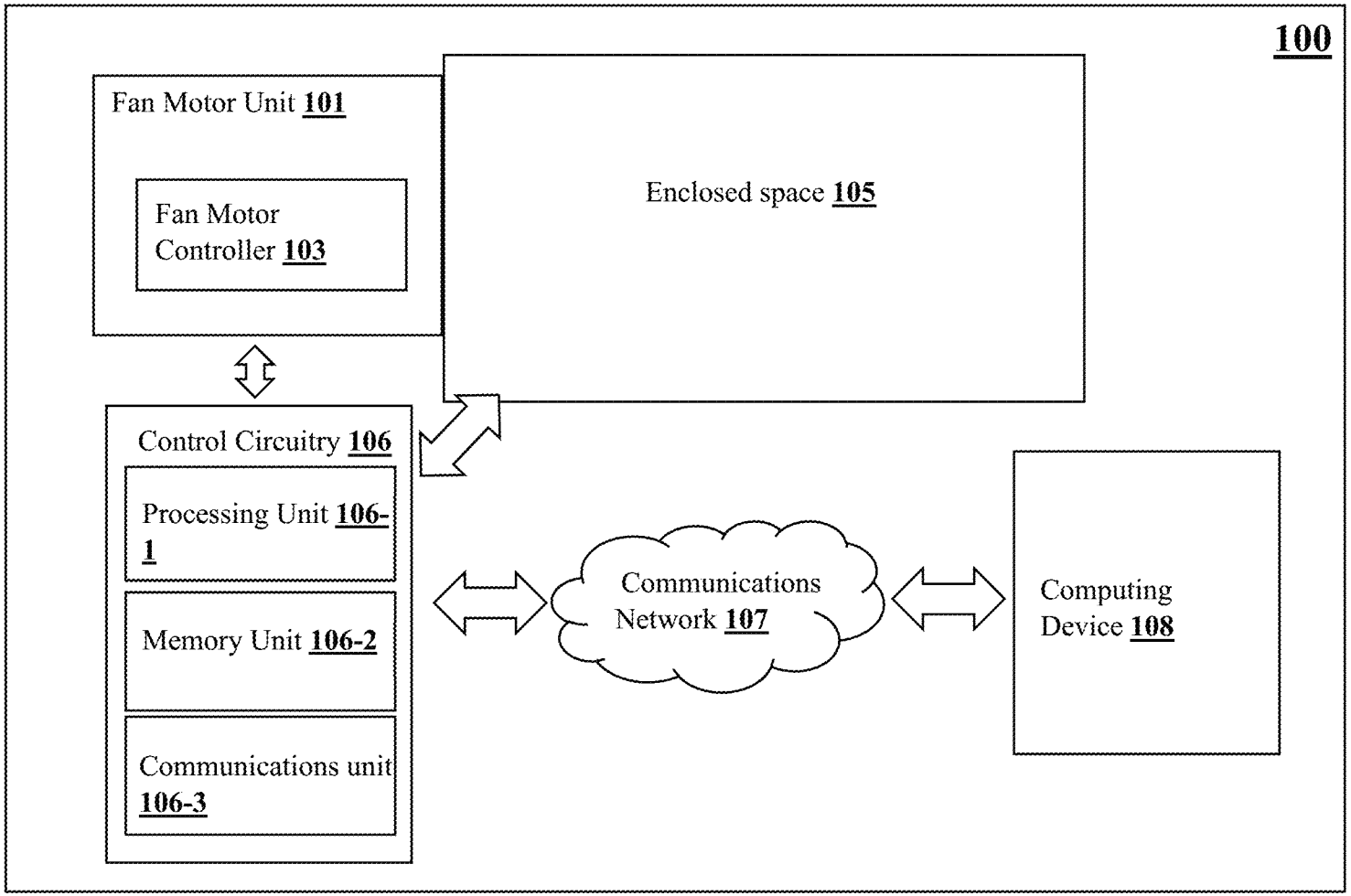
FIG. 2 illustrates a block diagram of a system for predicting failure of an HVAC fan motor unit implemented according to the disclosure.

FIG. 2 illustrates a system 100 for predicting failure of the HVAC fan motor unit 101 implemented according to the disclosure. The system 100 for predicting failure of an HVAC fan motor unit 101 comprises at least one HVAC fan motor unit 101 and the control circuitry 106 configured to interact with the HVAC fan motor unit 101, an enclosed space 105, and a computing device 108 via a communications network 107. The HVAC fan motor unit 101 is adapted to drive at least one fan 102 for supplying air to the enclosed space 105. As used herein, the term "control circuitry 106" and "fan motor controller 103" may be construed to encompass one or a combination of microprocessors, suitable logic, circuits, audio interfaces, visual interfaces, haptic interfaces, or the like. The control circuitry 106 and the fan motor controller 103 may include, but are not limited to a microcontroller, a Reduced Instruction Set Computing (RISC) processor, an Application-Specific Integrated Circuit (ASIC) processor, a Complex Instruction Set Computing (CISC) processor, a central processing unit (CPU), a graphics processing unit (GPU), a state machine, and/or other processing units 106-1 or circuits.

The control circuitry 106 may also comprise suitable logic, circuits, interfaces, and/or code that may be configured to execute a set of instructions stored in a memory unit 106-2. The memory unit 106-2 may additionally store a set of test time durations characterizing a working HVAC fan motor unit. As used herein, the phrase "test time durations characterizing a working HVAC fan motor unit" means the duration of time taken by a new or healthy HVAC fan motor unit under test conditions to come to rest from the moment the HVAC fan motor unit receives a turn off signal from the control circuitry 106. This means, the time taken for a rotating fan to stop rotation or reach a speed of zero rotations per minute from the time the HVAC fan motor unit receives a deactivation signal is recorded under test conditions. This time can be measured and recorded by the original equipment manufacturer before installation. Since the "test time duration" may be different for different make or type of HVAC fan motor units, the test time durations of different HVAC fan motor units are recorded during test or inspection conditions to create a database or a set of test time durations for a healthy or working HVAC fan motor unit of different types or models. In an exemplary implementation of the memory unit 106-2 according to the disclosure, the memory unit 106-2 may include, but are not limited to, Electrically Erasable Programmable Read-only Memory (EEPROM), Random Access Memory (RAM), Read Only Memory (ROM), Hard Disk Drive (HDD), Flash memory, Solid-State Drive (SSD), and/or CPU cache memory.

In an embodiment according to the disclosure, the control circuitry 106 is integrated as a part of a thermostat of the HVAC system. Accordingly, the control circuitry 106 may also comprise a plurality of sensors configured to detect one or more parameters of the enclosed space 105. In an embodiment, the sensors may include one or a combination of temperature sensors, humidity sensors, air quality sensors, and the like. Using these sensors, the control circuitry 106 detects information regarding different parameters of the enclosed space 105. These include, but are not limited to temperature, humidity, and air quality of the enclosed space 105. The HVAC system functions primarily as a heater during winter when ambient temperatures fall below a predefined temperature. For example, a user or operator of the HVAC system may adjust the thermostat to a temperature of his/her choice, for example 23-28 degrees Celsius. The control circuitry 106 transmits the activation signal to the fan motor controller 103 during a heating cycle based on a temperature of the enclosed space 105 falling below the predefined temperature. The fan motor controller 103 actuates the HVAC fan motor unit 101 to drive the fan 102 to blow air over heating coils in contact with the air within the enclosed space 105. The heated air circulates within the enclosed space 105 to raise the temperature to the predefined temperature. Once the control circuitry 106 receives feedback from the sensors, the control circuitry 106 transmits a deactivation signal during the heating cycle based on the temperature of the enclosed space 105 rising above the predefined temperature. Accordingly, the fan motor controller 103 deactivates the HVAC fan motor unit 101 to stop rotation of the fan 102 supplying air.

The HVAC system functions primarily as a cooler during summer when ambient temperatures rise above the predefined temperature. In this scenario, the control circuitry 106 transmits the activation signal during a cooling cycle based on the temperature of the enclosed space 105 rising above the predefined temperature. The fan motor controller 103 actuates the HVAC fan motor unit 101 to drive the fan 102 to blow air over evaporator coils (containing refrigerant) in contact with the air within the enclosed space 105. Similarly, the control circuitry 106 transmits the deactivation signal during a cooling cycle based on the temperature of the enclosed space 105 falling below the predefined temperature. In an embodiment, the predefined temperature may be set by a user via an interface of the control circuitry 106 or by using an interface of the computing device 108. The control circuitry 106 is configured to receive an input for adjusting the predefined temperature of the enclosed space 105. During operation both in the heating and cooling cycles, when the fan motor controller 103 receives a deactivation signal from a control circuitry, for each deactivation signal received, the fan motor controller 103 is configured to measure a time duration between reception of the deactivation signal from the control circuitry 106 and a speed of the fan 102 reaching zero rotations per minute (RPM). This measured time duration is transmitted to the control circuitry 106.

The control circuitry 106 may use a variety of techniques known in the art to control the operation of the HVAC fan motor unit 101 and the speed of a DC fan motor. The simplest control technique used includes an on/off switch that may be either manually or automatically controlled. If speed control is desired with such an approach, a rheostat may be added to the circuit and, thereby providing control over the DC voltage supplied to the HVAC fan motor unit 101. The control circuitry 106 may also employ pulse-width modulation (PWM) to activate/deactivate the HVAC fan motor unit 101. The control circuitry 106 may use PWM switches to switch the power to the HVAC fan motor unit 101 on and off at a fixed frequency.

The control circuitry 106 receives the measured time duration from the fan motor controller 103. The control circuitry 106 compares the received time duration with at least one test time duration from the set of stored test time durations to generate a delta time duration variable. For example, based on the type and make of the HVAC fan motor unit 101, the control circuitry 106 retrieves the test time duration corresponding to the type and make of the HVAC fan motor unit 101 installed within the HVAC system. As used herein, the "delta time duration variable" refers to the difference in values of the received time duration and the stored test time duration for the type and make of the HVAC fan motor unit 101 installed in the HVAC system. The received time duration includes the actual time taken by the fan 102 to come to rest or the time taken by the fan to reach zero RPM during operation. The control circuitry 106 determines if the generated delta time duration variable exceeds a threshold time duration. If the control circuitry 106 determines the generated delta time duration variable exceeds the threshold time duration, the control circuitry 106 generates at least one or a combination of an audio notification, a haptic notification, or a visual notification on a computing device 108 via a communications network 107. Sometimes, in case of events like sudden bearing failures, unscrewed fan sleeves, sudden spike in current drawn, may cause the delta time duration variable to exceed the threshold time duration. The audio notification, haptic notification or visual notification generated on the computing device 108 will therefore allow maintenance personnel or building management systems monitoring the computing device 108 to detect the event and notify the relevant team in a timely manner thereby enhancing the life of the HVAC fan motor unit 101.

Finally, the control circuitry 106 is configured to predict a failure time duration for the generated delta time duration to reach the threshold time duration. As used herein, the term "failure time duration" refers to the time predicted by the control circuitry 106 within which the generated delta time duration will exceed the threshold time duration. The control circuitry 106 predicts the "failure time duration" based on analysing a plurality of generated delta time durations during a monitoring period. As used herein, the term "monitoring period" refers to a period such as a day, consecutive days, one or more weeks, one or more months, a year, and the like over which the generated delta time durations are collected by the control circuitry 106. Several data modelling techniques are used to analyse the generated delta time durations collected by the control circuitry 106 during the monitoring period. Examples of data modelling techniques includes, but are not limited to, time series forecasting, Generalized Linear Models, and the like. These data modelling methods also work similar to the exemplary linear regression model disclosed herein. Once the failure time duration is determined, the control circuitry 106 indicates the predicted failure time duration on an interface of the computing device 108 or a service interface of the HVAC fan motor unit 101. In an embodiment, the threshold time duration is provided by the Original Equipment Manufacturer (OEM) and forms the baseline values with which the comparison is completed to predict the failure time duration. Optionally, the threshold time duration is modifiable by a user using an interface of the control circuitry 106 or an interface of the computing device 108. This means the user may adjust the threshold time duration based on his/her preference to prevent unintended triggering or in case of faulty sensors.

In an embodiment, the control circuitry 106 comprises a communications unit 106-3 configured to transmit the activation and deactivation signals to the HVAC fan motor unit 101. Further, the communications unit 106-3 is configured to receive sensor data variables from sensors detecting one or more parameters from the enclosed space 105. The communications unit 106-3 also transmits data to and receives data from the computing device 108 via the communications network 107. The communications unit 106-3 may be configured of, for example, a telematic transceiver (DCM), a mayday battery, a GPS, a data communication module ASSY, a telephone microphone ASSY, and a telephone antenna ASSY. The information transmitted from the control circuitry 106 to the computing device 108 may include, for example, information regarding the predefined temperature range set for the enclosed space 105, information regarding the threshold time duration for the HVAC fan motor unit 101, information regarding the predicted failure time duration, information regarding the location of the HVAC fan motor unit 101 (for example, a latitude, a longitude, the name of a place, a road name, and a road shape), the information with regards to the model and manufacturer name, etc. The transmitted information is useful for large HVAC systems that span a huge area such as district cooling systems, chiller systems for malls, and the like. In such implementations, the control circuitry 106 may not be integrated with the thermostat. The control circuitry 106 may be implemented remotely from the HVAC fan motor unit 101 with communications largely completed over a wireless communications network 107.

The communications network 107 may include, but is not limited to, a Wide Area Network (WAN), a cellular network, such as a 3G, 4G, or 5G network, an Internet-based mobile ad hoc networks (IMANET), etc. When the control circuitry 106 is implemented as part of the thermostat, the communications network 107 may also include wired media such as a wired network or direct-wired connection, and wireless media such as acoustic, radio frequency (RF), microwave, infrared (IR) and other wireless media. In the event of a threshold time duration being breached due to a sudden or unforeseen event, the communications unit 106-3 of the control circuitry 106 generates a trigger signal which is conveyed to an interface or communications unit of the computing device 108. When the computing device 108 receives the trigger signal, the computing device 108 generates an audio notification. The audio notification may include a loud warning siren or alarm which may be generated for a continuous or periodic interval of time. The audio notification is configured to be cleared or switched off based on an input received via the computing device 108, after which time the computing device 108 resumes to a normal indication without the emergency audio notification. The input may include an input received via a haptic interface of the computing device 108, an ON/OFF switch, biometric/RFID authentication by authorized security or safety personnel, etc. This means the audio notification provides the alert continuously to the operator of the computing device 108 until the operator shuts off the notification.

In some exemplary implementations according to the disclosure, the computing device 108 generates a visual notification in addition to the audio notification via a display interface of the computing device 108. The display may comprise suitable logic, circuitry, interfaces, and/or code that may be configured to render various types of information and/or entertainment content via a user interface. In an embodiment, the display may be a flashing visual indicator, such as a light emitting diode (LED), halogen lamps, indicator lights, or the like. The user interface may be a customized graphic user interface (GUI) configured to display information such as the predefined temperature, test time durations, failure time duration, monitoring period, threshold time duration, etc. The display may include but is not limited to a projection-based display, an electro-chromic display, a flexible display, and/or holographic display. In other embodiments, the display may be a touchscreen display, a tactile electronic display, and/or a touchable hologram. As such, the display may be configured to receive inputs from the operator for setting or modifying the predefined temperature ranges, the threshold time duration, etc. In an embodiment, the authorized personnel/operator may be prompted to clear the audio or visual notification. Alternately, the audio notification, the visual notification, or the audio-visual notification is configured to stop only based on an input received from the operator via the computing device 108. Consequently, the computing device 108 configures the audio interface and/or the display interface to return to a normal indication mode.

In an embodiment, the computing device 108 may be implemented as a portion of a small-form factor portable (or mobile) electronic device such as a cell phone, a personal data assistant (PDA), a personal media player device, a wireless web-watch device, a personal headset device, an application specific device, or a hybrid device that include any of the above functions. The computing device 108 may also be implemented as a personal computer including both laptop computer and non-laptop computer configurations. The computing device 108 can also be any type of network computing device. The computing device 108 can also be an automated system as described herein. The computing device 108 may have additional features or functionality, and additional interfaces to facilitate communications between basic configuration and any other devices and interfaces. For example, a bus/interface controller may be used to facilitate communications between a basic configuration and one or more data storage devices via a storage interface bus. Data storage devices may be removable storage devices, non-removable storage devices, or a combination thereof. Examples of removable storage and non-removable storage devices include magnetic disk devices such as flexible disk drives and hard-disk drives (HDD), optical disk drives such as compact disk (CD) drives or digital versatile disk (DVD) drives, solid state drives (SSD), and tape drives to name a few. Example computer storage media may include volatile and non-volatile, removable and non-removable media implemented in any method or technology for storage of information, such as computer readable instructions, data structures, program modules, or other data systems can also be used for data analysis and to determine when (e.g., acceleration and/or speed).

Figure 3:
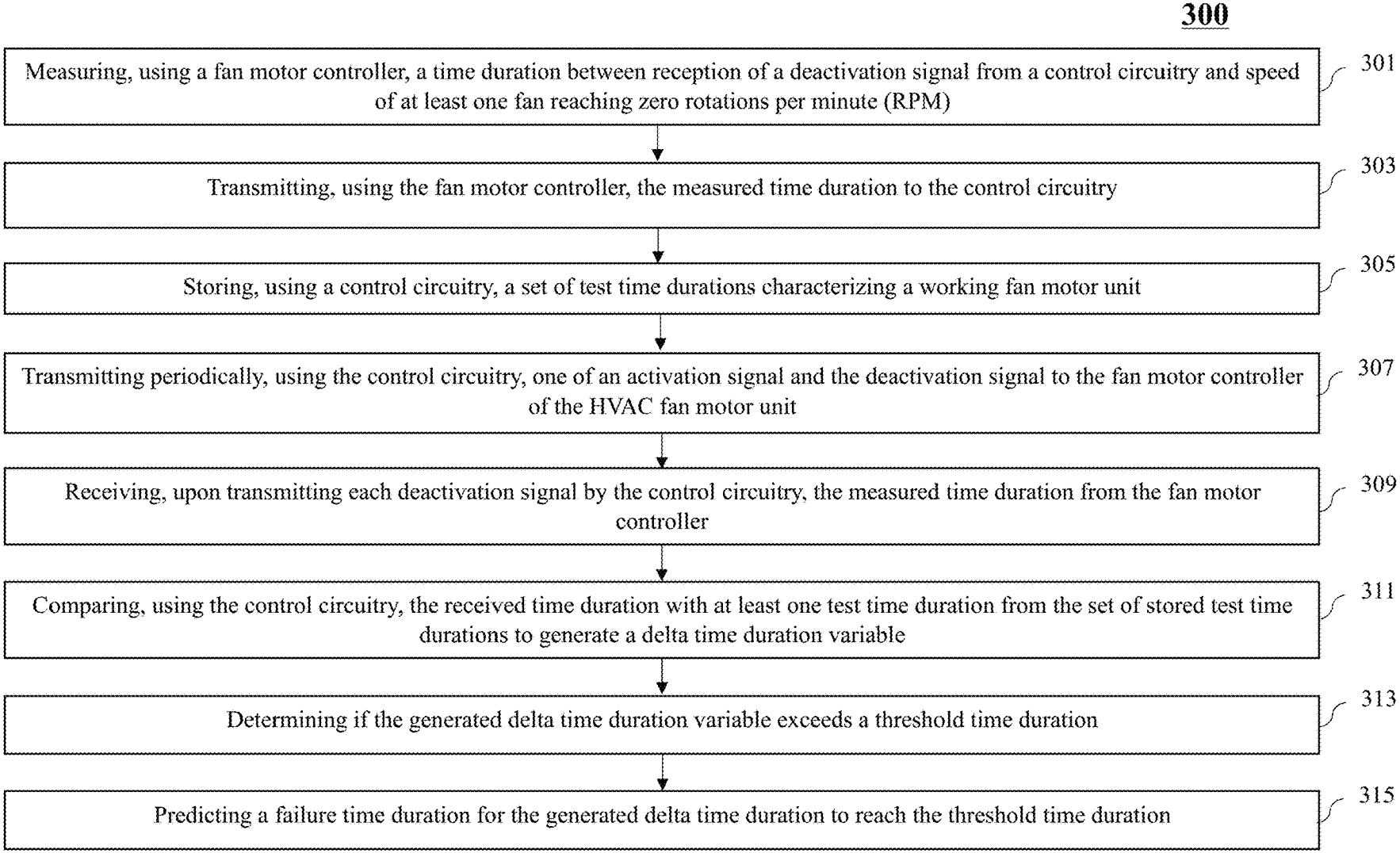
FIG. 3 illustrates a flowchart depicting a method for predicting failure of the HVAC fan motor unit according to the disclosure.

FIG. 3 exemplarily illustrates a flowchart depicting a method 300 for predicting failure of the HVAC fan motor unit 101 according to the disclosure. For the sake of brevity, features of the system that are already explained in detail in the description of FIG. 1 and FIG. 2 are not explained in detail in the description of FIG. 3. The method 300 may be implemented by the system for predicting failure of the HVAC fan motor unit 101.

At Step 301, the fan motor controller 103 measures a time duration between reception of a deactivation signal from a control circuitry 106 and speed of at least one fan 102 reaching zero rotations per minute (RPM). For example, based on the demand from the HVAC system, the control circuitry 106 transmits an activation (ON) or deactivation (OFF) signal using the communications unit 106-3 as disclosed in the detailed description of FIG. 2. If a deactivation signal is transmitted, the fan 102 is switched off and the speed (rotations per minute) reaches zero RPM. This time duration is measured by the fan motor controller 103 for every ON/OFF cycle.

At Step 303, the fan motor controller 103 transmits the measured time duration to the control circuitry 106. In an embodiment, the fan controller 103 transmits the measured time duration for each ON/OFF cycle. In other embodiments, the fan controller 103 may be configured to transmit periodically to save power consumption. Since the control circuitry 106 can fetch the measured time duration from the fan controller 103 directly, no additional sensors or complex detection mechanisms may be implemented and therefore only programming changes are sufficient to implement the system 100 for predicting failure of the HVAC fan motor unit 101.

At Step 305, the control circuitry 106 stores a set of test time durations characterizing a working HVAC fan motor unit.

At Step 307, the control circuitry 106 periodically transmits an activation signal or the deactivation signal to the fan motor controller 103 of the HVAC fan motor unit 101.

At Step 309, upon transmitting each deactivation signal by the control circuitry 106, the control circuitry 106 receives the measured time duration from the fan motor controller 103;

At Step 311 the control circuitry 106 compares the received time duration with at least one test time duration from the set of stored test time durations to generate a delta time duration variable.

At Step 313, the control circuitry 106 determines if the generated delta time duration variable exceeds a threshold time duration. The control circuitry 106 is configured to generate at least one of an audio notification, a haptic notification, and a visual notification on a computing device 108 via a communications network 107 based on the generated delta time duration variable exceeding the threshold time duration. Alternatively, the control circuitry 106 generates a notification on a service interface of the HVAC fan motor unit 101 if the threshold time duration is exceeded. This step allows notification of a user in case there are sudden or unexpected changes in the generated delta time duration variables. Some cases like sudden bearing failures, unscrewed fan sleeves can be detected and notified to the relevant team in a timely manner based on sudden or unexpected changes in the generated delta time duration variables. This could mean the HVAC fan motor unit 101 has malfunctioned and may be inspected.

At Step 315, the control circuitry 106 predicts a failure time duration for the generated delta time duration to reach the threshold time duration. The step of predicting the failure time duration is completed by performing data modelling techniques on the generated delta time durations over a monitoring period. In an exemplary embodiment, the control circuitry 106 performs a linear regression to fit a line to the delta time duration variables generated for the periodically transmitted deactivation signals during the monitoring period. Next, a slope of the line is identified as a rate-of-change of the delta time duration variables during the monitoring period. Finally, the failure time duration is predicted at which the value of the delta time duration variables will reach the threshold time duration based on extrapolation of the identified slope as disclosed in the detailed description of FIG. 4. Once the failure time duration is predicted, the control circuitry 106 is configured to indicate the predicted failure time duration on at least one of an interface of a computing device 108 and a service interface of the HVAC fan motor unit 101. This notifies to a user or a service team timely to perform scheduled maintenance. In an embodiment, the data modelling techniques may be conducted on a cloud platform or the control circuitry 106 itself based on processor capacity. Consequently, significant amount of failures/unit shutdowns can be saved by doing timely scheduled maintenance. Since the system 100 utilizes the rotation data of the HVAC fan motor unit 101 collected by the control circuitry 106, additional sensors or complex monitoring systems are eliminated. This means the time to failure is determined with minimal increase in complexity and cost relative to existing systems. Moreover, significant or quick Warranty cost savings are achieved by implementation of the system 100 for predicting failure of the HVAC fan motor unit 101.

Figure 4:
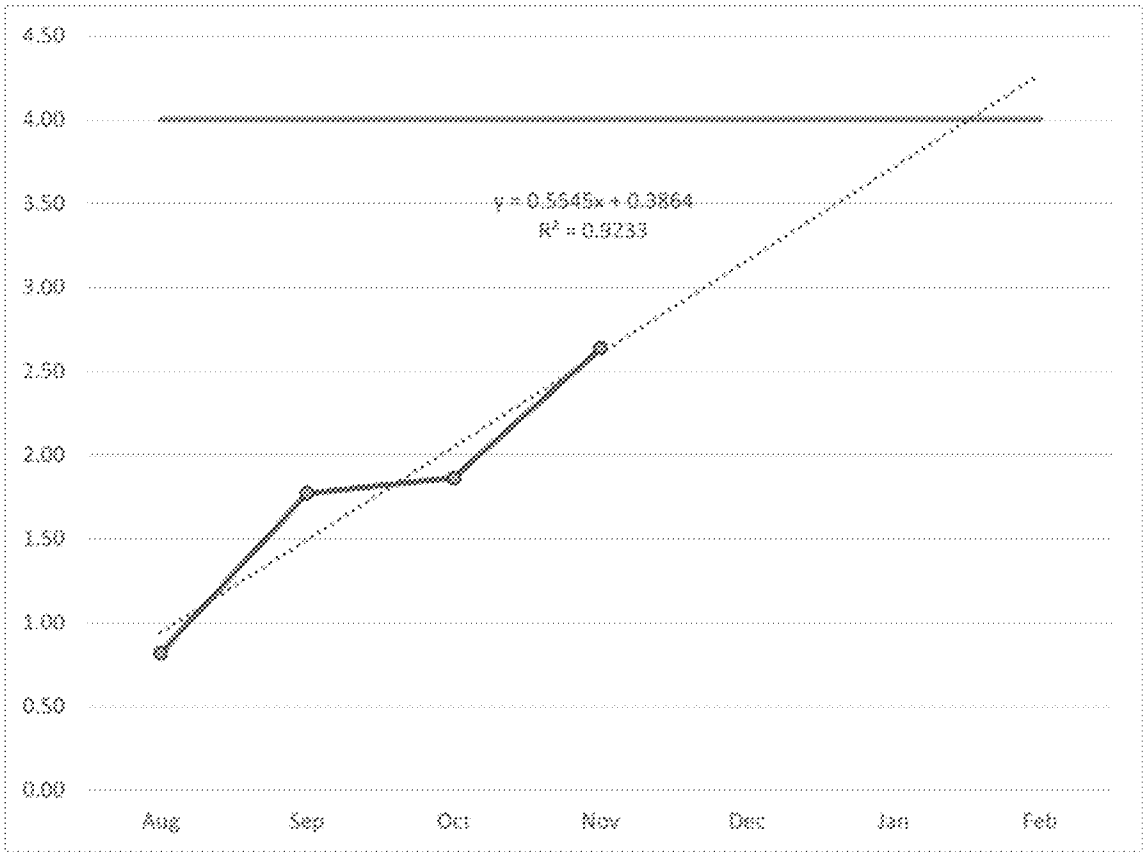
FIG. 4 exemplarily illustrates a sample graph depicting sample delta time durations plotted against months of the year.

FIG. 4 exemplarily illustrates a sample graph depicting sample delta time durations plotted against months of the year. As depicted in the sample graph, the y-axis includes the sample delta time durations in seconds. The delta time durations include the difference between the time taken by a healthy HVAC fan motor unit 101 to reach a stop position and the actual time taken by a monitored HVAC fan motor unit 101 to reach the stop position. This difference increases with the time as shown in the graph. In an exemplary embodiment, 4 seconds is taken as the threshold time duration. As discussed earlier, the step of predicting failure time duration for the generated delta time duration to exceed the threshold time duration includes performing a simple linear regression to fit a line to the delta time duration variables generated for each deactivation signal during a monitoring period. In the exemplary graph, the monitoring period is monthly, and the delta time duration variables are plotted for the month. Next, a slope of the line is identified as a rate-of-change of the delta time duration variables during the monitoring period. For example, a simple linear regression method is used to identify the slope of the line. Finally, the failure time duration is predicted as the time at which the value of the delta time duration variables will reach the threshold time duration (4 second line drawn parallel to the x-axis) based on extrapolation of the identified slope to meet the threshold time duration. In the exemplary embodiment, the slope is identified to meet the threshold time duration line at a point corresponding to a day between the beginning of January and the beginning of February. Therefore, the HVAC fan motor unit 101 is predicted to fail before February and maintenance or repair can be planned way ahead of failure of the HVAC fan motor unit 101 thereby improving life of the component. Using this method, significant amount of failures/unit shutdowns can be saved by doing timely scheduled maintenance in addition to quick warranty cost savings using only Software logic changes ensuring quick implementation.

The disclosure may be realized in hardware, or a combination of hardware and software. The disclosure may be realized in a centralized fashion, in at least one computer system, or in a distributed fashion, where different elements may be spread across several interconnected computer systems. A computer system or other apparatus adapted for carrying out the methods described herein may be suited. A combination of hardware and software may be a general-purpose computer system with a computer program that, when loaded and executed, may control the computer system such that it carries out the methods described herein. The disclosure may be realized in hardware that comprises a portion of an integrated circuit that also performs other functions. It may be understood that, depending on the embodiment, some of the steps described above may be eliminated, while other additional steps may be added, and the sequence of steps may be changed.

As would be apparent to a person in the art, various working modifications may be made to the method in order to implement the inventive concept as taught herein.

Moreover, the actions of any flow diagram may not be implemented in the order shown; nor do all of the acts necessarily may be performed. Also, those acts that are not dependent on other acts may be performed in parallel with the other acts.

The drawings and the forgoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, orders of processes described herein may be changed and are not limited to the manner described herein.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical or essential feature or component of any or all the claims.

What is claimed is:

1. A system for predicting failure of a Heating, Ventilation and Air Conditioning (HVAC) fan motor unit, the system comprising:

a fan motor controller, upon receiving from a control circuitry a deactivation signal indicative of switching off at least one fan, configured to:

measure a time duration between reception of the deactivation signal from the control circuitry and a speed of the at least one fan reaching zero rotations per minute (RPM); and transmit the measured time duration to the control circuitry; and wherein the control circuitry is configured to:

transmit, periodically, one of an activation signal and the deactivation signal to the fan motor controller of the HVAC fan motor unit;

receive, upon transmitting the deactivation signal, the measured time duration from the fan motor controller;

compare the measured time duration with at least one test time duration from a set of stored test time durations to generate a delta time duration variable;

determine if the generated delta time duration variable exceeds a threshold time duration; and predict a failure time duration for the generated delta time duration variable to reach the threshold time duration.

2. The system as claimed in claim 1, wherein the control circuitry transmits the activation signal during a heating cycle based on a temperature of an enclosed space falling below a predefined temperature.

3. The system as claimed in claim 1, wherein the control circuitry transmits the deactivation signal during a heating cycle based on a temperature of an enclosed space rising above a predefined temperature.

4. The system as claimed in claim 1, wherein the control circuitry transmits the activation signal during a cooling cycle based on a temperature of an enclosed space rising above a predefined temperature.

5. The system as claimed in claim 1, wherein the control circuitry transmits the deactivation signal during a cooling cycle based on a temperature of an enclosed space falling below a predefined temperature.

6. The system as claimed in claim 1, wherein the control circuitry is configured to receive an input for adjusting a predefined temperature of a enclosed space.

7. The system as claimed in claim 1, wherein the fan motor controller is configured to measure the time duration between the reception of the deactivation signal from the control circuitry and the speed of the at least one fan reaching zero rotations per minute (RPM) upon receiving the deactivation signal during one of a heating cycle and a cooling cycle.

8. The system as claimed in claim 1, wherein predicting the failure time duration for the generated delta time duration variable to exceed the threshold time duration comprises: performing a linear regression to fit a line to delta time duration variables generated for periodically transmitted deactivation signals during a monitoring period; identify a slope of the line as a rate-of-change of the delta time duration variables during the monitoring period; and predict the failure time duration at which a value of the delta time duration variables will reach the threshold time duration based on extrapolation of the identified slope.

9. The system as claimed in claim 1, wherein the control circuitry is configured to generate at least one of an audio notification, a haptic notification, and a visual notification on a computing device based on the generated delta time duration variable exceeding the threshold time duration.

10. The system as claimed in claim 1, wherein the control circuitry is configured to indicate the predicted failure time duration on at least one of an interface of a computing device and a service interface of the HVAC fan motor unit.

11. A method for predicting failure of a Heating, Ventilation and Air Conditioning (HVAC) fan motor unit, the method comprising:

measuring, using a fan motor controller, a time duration between reception of a deactivation signal indicative of switching off at least one fan from a control circuitry and speed of the at least one fan reaching zero rotations per minute (RPM);

transmitting, using the fan motor controller, the measured time duration to the control circuitry;

storing, using the control circuitry, a set of test time durations characterizing a working fan motor unit;

transmitting periodically, using the control circuitry, one of an activation signal and the deactivation signal to the fan motor controller of the HVAC fan motor unit;

receiving, upon periodically transmitting the deactivation signal by the control circuitry, the measured time duration from the fan motor controller;

comparing, using the control circuitry, the measured time duration with at least one test time duration from the set of stored test time durations to generate a delta time duration variable;

determining if the generated delta time duration variable exceeds a threshold time duration; and predicting a failure time duration for the generated delta time duration variable to reach the threshold time duration.

12. The method as claimed in claim 11, wherein predicting the failure time duration variable for the generated delta time duration to exceed the threshold time duration comprises:

performing a linear regression to fit a line to delta time duration variables generated for periodically transmitted deactivation signals during a monitoring period;

identifying a slope of the line as a rate-of-change of the delta time duration variables during the monitoring period; and predicting the failure time duration at which a value of the delta time duration variables will reach the threshold time duration based on extrapolation of the identified slope.

13. The method as claimed in claim 11, wherein the control circuitry is configured to generate at least one of an audio notification, a haptic notification, and a visual notification on a computing device via a communications network based on the generated delta time duration variable exceeding the threshold time duration.

14. The method as claimed in claim 11, wherein the control circuitry is configured to indicate the predicted failure time duration on at least one of an interface of a computing device and a service interface of the HVAC fan motor unit.

15. The method as claimed in claim 11, wherein the control circuitry transmits the activation signal during a heating cycle based on a temperature of an enclosed space falling below a predefined temperature.

16. The method as claimed in claim 11, wherein the control circuitry transmits the deactivation signal during a heating cycle based on a temperature of an enclosed space rising above a predefined temperature.

17. The method as claimed in claim 11, wherein the control circuitry transmits the activation signal during a cooling cycle based on a temperature of an enclosed space rising above a predefined temperature.

18. The method as claimed in claim 11, wherein the control circuitry transmits the deactivation signal during a cooling cycle based on a temperature of an enclosed space falling below a predefined temperature.

19. The method as claimed in claim 11, wherein the control circuitry is configured to receive an input for adjusting a predefined temperature of an enclosed space.

20. The method as claimed in claim 11, wherein the fan motor controller is configured to measure the time duration between the reception of the deactivation signal from the control circuitry and the speed of the at least one fan reaching zero rotations per minute (RPM) upon receiving the periodically transmitted deactivation signal during one of a heating cycle and a cooling cycle.

* * * * *